United States Patent [19]

Llort

[11] Patent Number: 4,986,580

[45] Date of Patent: Jan. 22, 1991

[54] LOCK WITH A MECHANISM FOR LOCKING AND UNLOCKING BY MEANS OF AN ELECTROMAGNET

[76] Inventor: Oscar Llort, 3, rue Pierre Curie, 38100 Grenoble, France

[21] Appl. No.: 286,948

[22] Filed: Jan. 23, 1989

[30] Foreign Application Priority Data

Mar. 23, 1987 [FR] France ..... 87 03972

[51] Int. Cl.[5] ..... E05B 3/26

[52] U.S. Cl. ..... 292/201

[58] Field of Search ..... 292/201, 144, 347, 210, 292/359

[56] References Cited

U.S. PATENT DOCUMENTS

| | | | |
|---|---|---|---|
| 2,768,853 | 10/1956 | Davies | 292/201 X |
| 3,967,846 | 7/1976 | Schlage | 292/359 |
| 4,736,970 | 4/1988 | McGourty et al. | 292/359 |
| 4,810,014 | 3/1989 | McGourtry et al. | 292/359 X |

*Primary Examiner*—Richard E. Moore

*Attorney, Agent, or Firm*—Marshall, O'Toole, Gerstein, Murray & Bicknell

[57] ABSTRACT

Lock (1) comprising a mechanism (25) for locking and unlocking, by means of an electromagnet (34), a member (9) connecting or designed to connect a handle or other actuating means on the one hand and at least one latch (10) on the other hand, the said mechanism comprinsing an auxiliary element (26) designed so that, in one position, it is engaged with the said member (9) and, in another position, it is released from this member, a return means (31) acting on the said auxiliary element (27) so as to stress it towards one of its positions, the electromagnet (34) comprising a magnet (35) and a coil (38), a cam (39) and a cam follower (33), of which one is carried by the movable element (37) of the said electromagnet and the other by the said auxiliary element (26) and which are designed to interact in such a way that, when the movable element of the electromagnet changes from a first position to a second position, the auxiliary element changes from one of its positions to its other position counter to the said return means, and vice versa.

20 Claims, 2 Drawing Sheets

LOCK WITH A MECHANISM FOR LOCKING AND UNLOCKING BY MEANS OF AN ELECTROMAGNET

The present invention relates to a lock comprising a mechanism for locking and unlocking, by means of an electromagnet, a member connecting or designed to connect a handle or other actuation means on the one hand and at least one latch on the other hand.

According to the present invention, the said mechanism comprises an auxiliary element designed so that, in one position, it is engaged with the said member and, in another position, it is released from this member, a return means acting on the said auxiliary element so as to stress it towards one of its positions, an electromagnet comprising a magnet and a coil, a cam and a cam follower, of which one is carried by the movable element of the said electromagnet and the other by the said auxiliary element and which are designed to interact in such a way that, when the movable element of the electromagnet changes from a first position to a second position, the auxiliary element changes from one of its positions to its other position counter to the said return means, and vice versa.

According to another object of the present invention, the said handle is connected to the said member by disengageable means allowing this handle to rotate relative to this member when the torque exerted on it is higher than a specific value.

According to the present invention, the said member can comprise a shaft coaxial relative to the said handle, this handle and this shaft having two opposing faces, between which there are elastic means ensuring the disengagement of the said handle when the torque exerted on it is higher than a specific value.

According to the present invention, one of the said faces preferably has notches, whilst the other carries elastic means penetrating into these notches.

According to another object of the present invention, the said mechanism comprises means for preventing the said auxiliary element from moving before the said cam and the said cam follower interact in order to cause this auxiliary element to change from one of its positions to its other position.

According to another object of the present invention, the said mechanism comprises at least one pendulous element allowing the said auxiliary element to move from one of its positions only when they are in specific positions.

According to another object of the present invention, the said member consists of a shaft, the said auxiliary element consists of an articulated lever which can assume a first position, in which it prevents the said shaft from rotating, and a second position, in which this shaft is free, and the said return element stresses this articulated lever towards its first position, the movable element of the said electromagnet being designed to move linearly and horizontally.

According to the present invention, the said lever can extend perpendicularly relative to the said shaft and the movable element of the said electromagnet is designed to move perpendicularly relative to the said shaft.

According to the present invention, the said mechanism can advantageously comprise a pendulous element allowing the said lever to move from its first position towards its second position only when they are in specific relative positions.

According to the present invention, the movable element of the said electromagnet and the said lever can advantageously carry stops which prevent the said lever from moving before the said cam and the said cam follower interact in order to cause this lever to change from its first position to its second position.

The present invention will be understood better from a study of a lock described by way of non-limiting example and illustrated in the drawing in which.

Figure 1:
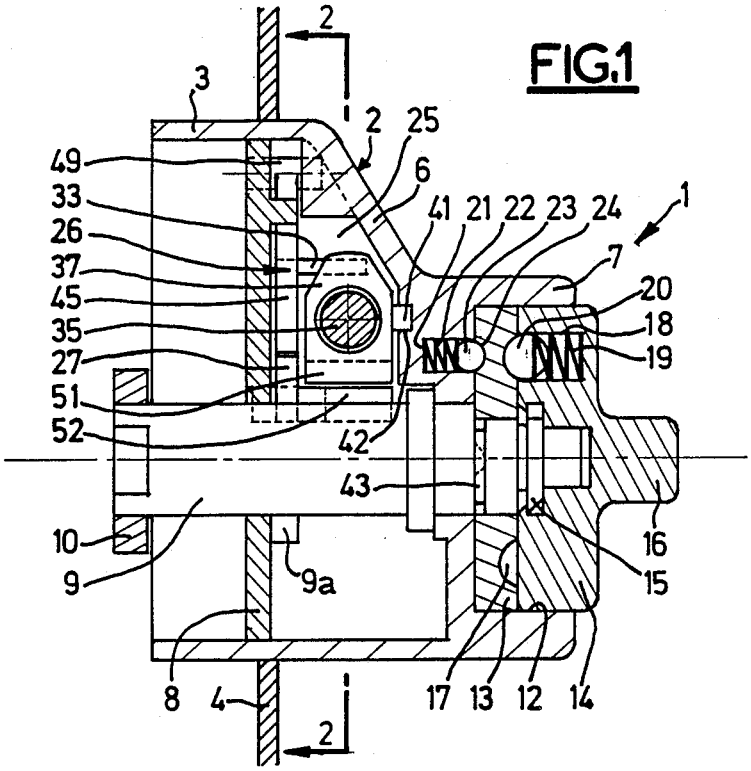
FIG. 1 shows a vertical cross-section of a lock according to the present invention along the line I—I of FIG. 2.
Figure 4:
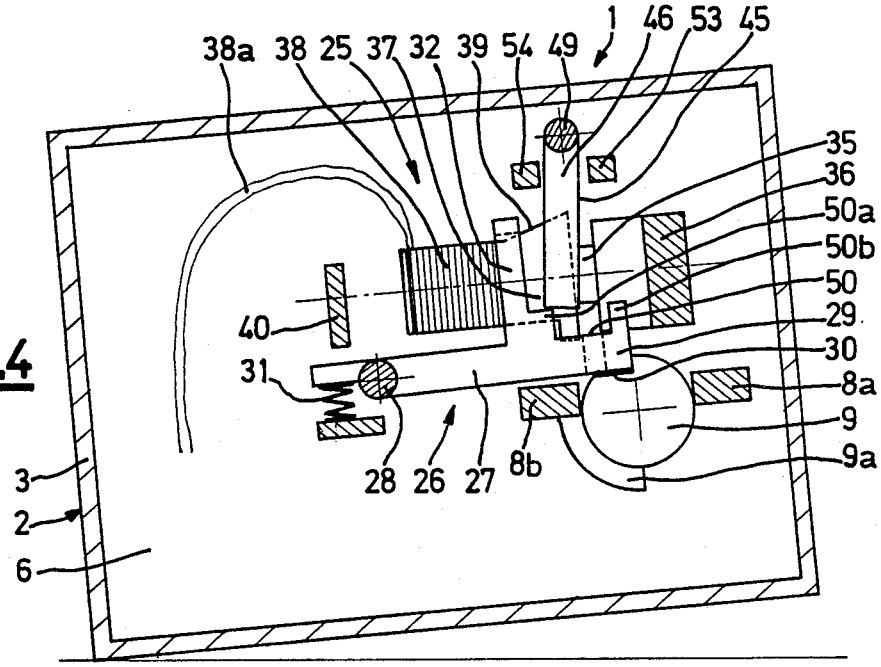
FIG. 4 shows an inner rear view of the lock shown in FIG. 1, the latter being inclined.

The lock illustrated in the figures and designated as a whole by the reference 1 comprises a hollow body designated as a whole by the reference 2. This body 2 comprises a part of rectangular cross-section 3 which is fitted through and secured in an opening element, such as a door 4 in which a rectangular passage 5 is made, a front wall 6 inclined outwards from top to bottom and having a projecting part 7 in its lower left-hand portion, and a rear wall 8 arranged set back relative to the rear edges of the part of rectangular cross-section 3.

The lock 1 has a member formed from a transverse shaft 9 which is mounted rotatably in the projecting part 7 of the front wall 6 and in the rear wall 8. Fastened radially on the rear end of the shaft 9 is a latch 10 which, when the shaft 9 pivots through 90°, changes from a vertical opening position to a horizontal closing position for the door 4, in which it extends, for example, at the rear of a fixed pillar 11 shown only in FIG. 2. To limit the angular deflection of the shaft 9, the latter carries a boss **9*a*, and the front or inner face of the rear wall 8 carries two bosses 8*a* and 8*b* which the boss 9*a*** comes up against.

In the projecting part 7 of the front wall 6 of the case 2 there is a flat-bottom recess 12 concentric relative to the shaft 9. In this recess 12 there are an annular plate 13 fixed in terms of relative rotation to the shaft 9 and then a handle in the form of an operating button 14, which is mounted rotatably on the front end of the shaft 9 and which is retained axially by means of a snap connection 15. This operating button 14 has, on its front face, a radial grasping rib 16 located outside the projecting part 7 of case 2.

The front radial face of the plate 13 located opposite the rear radial face of the button 14 has a multiplicity of hemispherical notches 17 arranged on the same circumference. In the rear face of the button 14 there is a recess 18, in which are arranged a spring 19 and a ball 20 which, under the effect of this spring 19, is pushed towards the plate 13 so as to engage partially in the notches 17 of this plate 13. The assembly composed of the notches 17, of the ball 20 and the spring 19 forms a disengageable elastic connection between the operating button 14 and the shaft 9.

Furthermore, in the bottom of the recess 12 in the projecting part 7 of the case 2 there is a recess 21, in which are arranged in succession a spring 22 and a ball 23 which, under the effect of the spring 22, is pushed towards the rear face of the plate 13, this rear face of the plate 13 having two hemispherical notches 24 at 90°, into which the ball 23 partially engages when the shaft 9 occupies its two end positions corresponding to the two 90° end positions of the latch 10.

Associated with the shaft 9 is a locking/unlocking mechanism, designated as a whole by the reference 25, which is arranged in the case 2 between its front wall 6 and its rear wall 8.

This locking mechanism 25 comprises a lever 26 movable in a vertical plane perpendicular relative to the shaft 9. This lever 26 has an arm 27 which is adjacent to the rear wall 8 and of which the right-hand end furthest away from the shaft 9 possesses laterally cylindrical bosses 28 forming axles rotating respectively in the front face 6 and in the rear face 8, and the left-hand end 29 of which is designed to engage into a recess 30 made in the periphery of the shaft 9. When the arm 27 is horizontal, its end 29 being engaged in the recess 30, it forms a tangential stop in terms of rotation for the shaft 9 and prevents the latter from leaving its horizontal position, in which the latch 10 is in its closing position, and, when it is pivoted upwards, its left-hand end 29 being released from the recess 30, the shaft 9 can be actuated by means of the button 14 between its two end positions seen above. A spring 31 is provided in order to stress this arm 27 towards its position for locking the shaft 9.

The lever 26 also has, between its ends 28 and 29, an arm 32 which extends upwards and, starting from the upper end of this arm 32, a lateral arm 33 which extends horizontally away from the rear wall 8.

Laterally relative to the vertical arm 32 and underneath the transverse arm 33 there is an electromagnet designated as a whole by the reference 34. This electromagnet 34 comprises a magnet 35 of cylindrical cross-section which extends perpendicularly relative to the shaft 9 and the left-hand end of which is carried by a projecting part 36 of the rear wall 8, this part 36 being located above and at a distance from the shaft 9. Mounted slidably on the electromagnet 35 to the right of the magnet carrier 36 is a coil form 37, on which a coil 38 is wound and which, in its upper left-hand part, has an inclined surface 39 forming a cam. When the coil form 37 slides on the magnet 35 from its position retracted furthest to the left up against the magnet carrier 36 towards its advanced position furthest to the right, where a stop 40 projecting from the rear wall 8 is provided in order to limit its travel, the cam 39 of the coil form 37 slides under the lateral arm 33 of the lever 26 forming a cam follower and lifts it, thus making it possible to cause the lever 26 to change from its position locking the shaft 9 to its non-locking position for this shaft 9, and vice versa when the coil form 37 moves in the other direction. These two end positions can be seen respectively in FIGS. 2 and 3.

To prevent the coil form 37 from rotating about the magnet 35, FIG. 1 shows that the coil form 37 has a lateral finger 41 which is engaged in a longitudinal groove 42 provided in the rear face of the front wall 6 of the case 2, this finger 41 sliding in this groove 42 during the sliding of the coil form 37 on the magnet 35.

Figure 2:
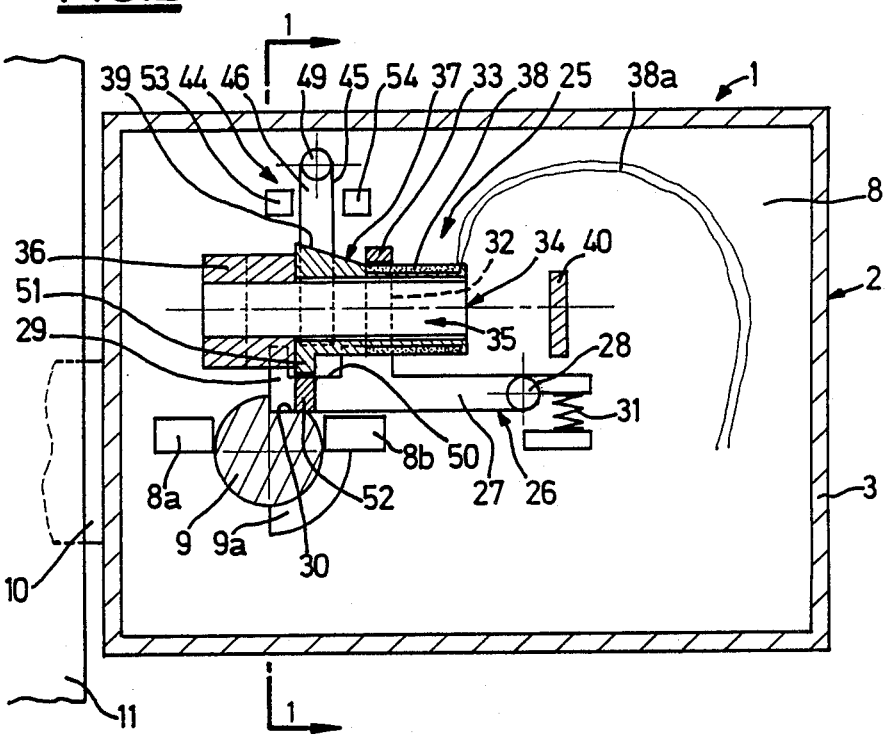
FIG. 2 shows a longitudinal section of the lock of FIG. 1 along the line II—II, its mechanism being in the locking position.
Figure 3:
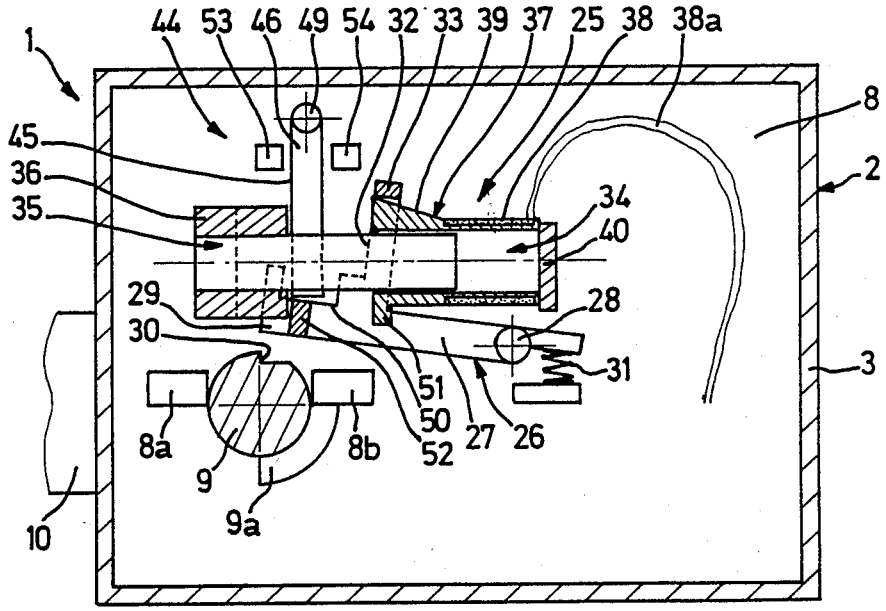
FIG. 3 shows a view of the lock of FIG. 1 corresponding to that of FIG. 2, its mechanism being in the unlocked position.

In its closing position which can be seen in FIGS. 1 and 2, the lock 1 is in the following state: the shaft 9 is in its end position, in which its boss 9*a* is up against the boss 8*b*, the latch 11 is horizontal and in its closing position, the coil form 37 is in its retracted position and the locking lever 26 is in its low position, in which it prevents the shaft 9 from rotating towards the position for opening the latch 10.

If an attempt is made to rotate the shaft 9 by means of the operating button 14, the shaft 9 does not move. When the torque exerted on the operating button 14 is higher than a specific value, this operating button 14 rotates on the front end of the shaft 9 and the ball 20 passes from one notch 17 to the following notch 17 in succession, overcoming the force exerted on it by the spring 19. The deliberate breaking of the shaft 9 as a result of rotation of the operating button 14 is thus prevented. In addition to this safety feature, FIG. 1 shows that the shaft 9 has a weakening groove 43 located at the rear of the snap connection 15 and at the front of the recess 30 of the shaft 9, in the plane of the flat bottom of the recess 12. Beyond a specific force exerted on the operating button 14 other than a rotational force, the shaft 9 breaks at the weakening groove 43. The operating button 14 separates from it, but there is no longer any possible hold on the remaining front end of the shaft 9.

If an electrical pulse is transmitted to the coil 38, for example from an electronic identification circuit (not shown) connected to the coil 38 by means of a flexible electrical lead 38*a*, this electronic circuit being arranged, for example, in the case 2 at the rear of its rear wall 8 and receiving, for example, an identification code entered by means of a keyboard carried by the inclined outer face of the front wall 6, the coil form 37 moves from its retracted position to its advanced position and lifts the locking lever 26, thus freeing the shaft 9. This position, in which the locking lever 26 is in its high position, can be seen in FIG. 3.

If the operating button 14 is rotated in the clockwise direction, the shaft 9 also being rotated thereby, the latch 10 can then be brought from its horizontal closing position into its vertical opening position, the boss 9*a* coming up against the boss 8*a*. These two end positions are maintained by means of the elastic system consisting of the spring 22 and of the ball 23 which engage respectively in the two notches 24 in the plate 13 which are arranged at 90°.

After a predetermined time, for example a few seconds, the electronic circuit transmits a reverse pulse to the coil 38, the coil form 37 returns to its retracted position and the locking lever 26 is released. If the latch 10 is still in its vertical opening position, the lower face of the locking arm 27 of the locking lever 26 comes to bear on the peripheral face of the shaft 9. As soon as the latch 10 is returned to its horizontal closing position by rotating the operating button 14 in the other direction, the locking lever 26 continues its downward travel, and its left-hand end 29 engages into the notch 30 of the shaft 9 and locks the latter once again.

The lock 1 also possesses a security system, designated as a whole by the reference 44, which makes it possible to prevent any movement of the coil form 37 from its retracted position and the rise of the locking lever 26, especially when the apparatus carrying this lock 1 is shaken or tilted.

This system 44 comprises a pendulous element 45 comprising a vertical arm 46 which is adjacent to the rear wall 8 and the upper end of which has cylindrical lateral bosses 49 engaged respectively in the front wall 6 and in the rear wall 8 so as to form a joint parallel to the shaft 9. This arm 46 extends downwards towards the free end part of the arm 27 of the locking lever 26. When the lock 1 is in its normal position, the lower end of the arm 46 of the pendulous element 45 is located exactly opposite a recess 50 which is provided in the arm 27 of the locking lever 26 and into which it engages when the locking lever 26 is lifted, without preventing it from moving. Furthermore, the angular movement of the pendulous element 50 of a few degrees in a vertical plane perpendicular relative to the shaft 9 and above the arm 27 is limited, on either side of its vertical position, by two stops 53 and 54 projecting from the rear wall 8.

In addition to the pendulous element 45, the coil form 37, in its lower left-hand part, has a transverse projecting portion 51 and the arm 27 of the locking lever 26 has a lateral arm 52, which are arranged so as to form stops preventing the locking lever 26 from rising from its position locking the shaft 9, when the coil form 37 is in its retracted position, the transverse stop 51 of the coil form 37 coming free of the transverse arm 52 of the locking lever 26 after a slight travel of the coil form 37, as soon as the cam follower arm 33 reaches the cam 39.

If the apparatus carrying the lock 1 is shaken or tilted, the lower end of the pendulous element 45 comes above one of the edges **50*a* or 50*b* of the recess 50 provided in the arm 27 of the locking lever 26 and prevents the latter from rising, this rise also being prevented as a result of the corresponding stops 51 and 52 provided respectively on the coil form 37 and on the locking lever 26, the cam 39 comes up against the cam follower arm 33, and the movement of the coil form 37 towards its advanced position is thereby stopped, the locking lever 26 being incapable of rising and therefore remaining in its position locking the shaft 9**.

As soon as the lock 1 resumes its stable normal position, in which the lower end of the pendulous element 45 is opposite the recess 50 in the arm 27 of the locking lever 26, the lock 1 can be used normally in the way described above.

The present invention is not limited to the example described above. Many alternative embodiments are possible, without departing from the scope defined by the accompanying claims.

I claim:

1. Lock comprising a mechanism for locking and unlocking a member connecting or adapted to connect a handle or other actuation means to at least one latch, said mechanism comprising:

an auxiliary element movable between a first position in which it is engaged with said member and a second position in which it is released from said member, a return means biasing said auxiliary element toward one of said positions, an electromagnet comprising a movable element, a cam and a cam follower, one of said cam and cam follower being carried by the movable element of said electromagnet and the other by said auxiliary element, said cam and cam follower being adapted to cause said auxiliary element to move from one of its positions to its other position when the movable element of the electromagnet moves from a first position to a second position, said handle being connected to said member by disengageable means allowing said handle to rotate relative to said member when the torque exerted on it is higher than a specific value.

2. Lock according to claim 1, wherein said member comprises a rotatable shaft coaxial to said handle, said handle and said shaft having two opposing faces interconnected by elastic means permitting the disengagement of said handle from said shaft when torque higher than a specific value is exerted on it.

3. Lock according to claim 2, wherein one of said faces is provided with notches while the other face carries elastic means penetrating into said notches.

4. Lock comprising a mechanism for locking and unlocking a member connecting or adapted to connect a handle or other actuation means to at least one latch, said mechanism comprising:

an auxiliary element movable between a first position in which it is engaged with said member and a second position in which it is released from said member, a return means biasing said auxiliary element towards one of said positions, an electromagnet comprising a movable element, a cam and a cam follower, one of said cam and cam follower being carried by the movable element of the said electromagnet and the other by said auxiliary element, said cam and cam follower being adapted to cause said auxiliary element to move from one of its positions to its other position when the movable element of the electromagnet moves from a first position to a second position, said mechanism comprising at least one pendulous element allowing said auxiliary element to move from one of its positions only when they are in specific positions.

5. Lock according to claim 4, wherein said member consists of a rotatable shaft and said auxiliary element consists of an articulated lever movable between a first position in which it prevents said shaft from rotating, and a second position in which said shaft is free to rotate, and said return means biases said articulated lever towards its first position, said movable element of the said electromagnet being designed to move linearly and horizontally.

6. Lock according to claim 5, wherein said lever extends perpendicularly relative to said shaft and said movable element of the electromagnet is movable perpendicularly relative to said shaft.

7. Lock comprising a mechanism for locking and unlocking a member connecting or adapted to connect a handle or other actuation means to at least one latch, said mechanism comprising:

an auxiliary element movable between a first position in which it is engaged with said member and a second position in which it is released from said member, a return means biasing said auxiliary element towards one of its positions, an electromagnet comprising a fixed magnet and a coil carried by a coil carrier which is movable with respect to said fixed magnet, a cam and a cam follower, one of said cam and carrier being carried by said coil carrier and the other by said auxiliary element, said cam and cam follower being adapted to cause said auxiliary element to move from one of its positions to its other position when the movable element of the electromagnet moves from a first position to a second position, said magnet extending horizontally and said coil carrier being slidably mounted on said magnet for moving linearly.

8. Lock according to claim 7, wherein said coil carrier is provided with a horizontally guided lateral finger.

9. Lock according to one of claims 7 and 8 wherein said member consists of a shaft, said auxiliary element consists of an articulated lever which can assume a first position in which it prevents said shaft from rotating, and a second position in which said shaft is free to rotate, and said return element biases said articulated lever towards its first position.

10. Lock according to claim 9, wherein said mechanism comprises a pendulous element allowing said lever to move from its first position towards its second position only when they are in specific relative positions.

11. Lock according to claim 9, wherein said handle is connected to said shaft by disengageable means allowing said handle to rotate relative to said shaft when the torque exerted on it is higher than a specific value.

12. Lock according to claim 11, wherein said handle and said shaft are coaxial and have two opposing faces, between which there are elastic means permitting the disengagement of said handle from said shaft when the torque exerted on it is higher than a specific value.

13. Lock according to claim 12, wherein one of the said faces has notches while the other carries elastic means penetrating into said notches.

14. Lock comprising a mechanism for locking and unlocking a shaft connecting or designed to connect a handle or other actuation means and at least one latch, said mechanism comprising an articulated lever which can assume a first position in which it prevents said shaft from rotating, and a second position in which said shaft is free, and a return means biasing said articulated lever towards its first position, an electromagnet comprising a fixed magnet and a coil carried by a coil carrier and movable with respect to the affixed magnet, a cam and a cam follower, of which one is carried by said coil carrier of the said electromagnet and the other by said articulated lever, said cam and cam follower being adapted to cause said articulated lever to change from one of its positions to its other position which said coil carrier changes from said first position to said magnet extending horizontally and said coil carrier being slidingly mounted on said magnet for linear motion.

15. Lock according to claim 14, wherein said coil carrier is provided with a horizontally guided lateral finger.

16. Lock according to claim 14, wherein said magnet and said articulated lever extend perpendicularly to said shaft.

17. Lock according to claim 14, wherein said mechanism comprises at least one pendulous element allowing said articulated lever to move from its first position to its second position only when they are in specific positions.

18. Lock according to claim 14, wherein said handle is connected to the said shaft by disengageable means allowing said handle to rotate relative to said shaft when the torque exerted on it is higher than a specific value.

19. Lock according to claim 18, wherein said handle and said shaft have two opposing faces, between which there are elastic means ensuring the disengagement of said handle when the torque exerted on it is higher than a specific value.

20. Lock according to claim 19, wherein one of the said faces has notches while the other carries elastic means penetrating into said notches.

* * * * *